US007471251B2

(12) United States Patent
Kawasaki et al.

(10) Patent No.: US 7,471,251 B2
(45) Date of Patent: Dec. 30, 2008

(54) RADIO COMMUNICATION SYSTEM AND COMMUNICATION METHOD THEREFOR

(75) Inventors: Kenichi Kawasaki, Tokyo (JP); Keiji Fukuzawa, Chiba (JP)

(73) Assignee: Sony Corporation, Tokyo (JP)

( * ) Notice: Subject to any disclaimer, the term of this patent is extended or adjusted under 35 U.S.C. 154(b) by 50 days.

(21) Appl. No.: 11/744,076

(22) Filed: May 3, 2007

(65) Prior Publication Data

US 2007/0257849 A1 Nov. 8, 2007

(30) Foreign Application Priority Data

May 8, 2006 (JP) ..... 2006-129511

(51) Int. Cl.
*H01Q 1/24* (2006.01)

(52) U.S. Cl. ..... 343/702; 343/844

(58) Field of Classification Search ..... 343/702, 343/844, 893
See application file for complete search history.

(56) References Cited

U.S. PATENT DOCUMENTS 6,317,098 B1 * 11/2001 Andrews et al. ..... 343/797
2007/0069962 A1 * 3/2007 Lucidarme et al. ..... 343/702

FOREIGN PATENT DOCUMENTS

JP 2001-237757 8/2001
JP 2005-184564 7/2005

* cited by examiner

*Primary Examiner*—Tan Ho
(74) *Attorney, Agent, or Firm*—Bell, Boyd & Lloyd

(57) ABSTRACT

A radio communication system for performing radio communication between a first antenna and a second antenna is provided. Each of the first and second antennas includes a plurality of antenna elements for forming polarization planes orthogonal to each other in three-axial directions. The first and second antennas are arranged so that the polarization planes formed by the antenna elements of the first antenna are respectively opposed to the polarization planes formed by the antenna elements of the second antenna. The communication between the first antenna and the second antenna is performed by using three independent polarized waves.

3 Claims, 12 Drawing Sheets

RADIO COMMUNICATION SYSTEM AND COMMUNICATION METHOD THEREFOR

CROSS REFERENCES TO RELATED APPLICATIONS

The present application claims priority to Japanese Patent Application JP 2006-129511 filed in the Japan Patent Office on May 8, 2006, the entire contents of which is being incorporated herein by reference.

BACKGROUND

The present application relates to a radio communication system for performing radio communication by using a plurality of antennas and also to a communication method for the radio communication system.

In recent years, a radio communication function has been mounted not only on information processing equipment such as a personal computer and communication terminal equipment such as a mobile phone and a PDA (Personal Digital Assistant), but also on audio equipment, video equipment, camera equipment, and a printer. In association with this trend that a radio communication function has been mounted on various equipment, an antenna for transmitting or receiving radio waves is required to have various forms and characteristics.

In some case, such equipment having a radio communication function includes a plurality of antennas for producing different polarized waves for transmission or reception in order to increase a communication speed between transmitting radio equipment and receiving radio equipment. In the case of performing communication by using a plurality of different polarized waves, it can be theoretically said that communication can be performed by using the plural antennas respectively corresponding to different polarization planes. However, in actual, the plural antennas are mounted in the radio equipment so that the polarization planes are orthogonal to each other to suppress interference between the polarization planes.

In such equipment, the region occupied by the antennas becomes large. Japanese Patent Laid-open No. 2005-184564 discloses an antenna device having a substrate formed of a solid electrolyte and two antenna patterns formed of conductive plastic. The antenna patterns are provided on both surfaces of the substrate to receive and/or transmit different polarized waves orthogonal to each other.

There will now be described a change in communication sensitivity according to the polarization planes formed by a transmitting antenna and a receiving antenna. For example, as shown in FIG. 14, a transmitting antenna 30 and a receiving antenna 40 are respectively located at points G and H spaced apart from each other in the direction of the Z axis in an orthogonal three-dimensional coordinate system composed of X, Y, and Z axes orthogonal to each other.

In the case that three orthogonal antenna elements respectively extending in the directions of the X, Y, and Z axes are located at each of the points G and H, it is considered that communication between the three antenna elements of the transmitting antenna 30 and the three antenna elements of the receiving antenna 40 can be respectively performed by using three independent polarized waves obtained by respectively opposing the polarization planes formed by the three antenna elements of the receiving antenna 40 to the polarization planes formed by the three antenna elements of the transmitting antenna 30.

However, since the point G of the transmitting antenna 30 and the point H of the receiving antenna 40 lie on the same straight line extending in the direction of the Z axis, the propagation component of radio waves transmitted from the Z-axis antenna element of the transmitting antenna 30 is largely attenuated before reaching the point H, and therefore may not be received by the Z-axis antenna element of the receiving antenna 40. Accordingly, the polarization planes effectively usable for the communication are formed in the radial directions about the X axis and in the radial directions about Y axis, so that the communication between the remaining two antenna elements of the transmitting antenna 30 and the remaining two antenna elements of the receiving antenna 40 can be respectively performed by using two independent polarized waves.

Further, in the case of performing short-distance communication such that a transmitting antenna and a receiving antenna are spaced apart from each other by a short distance several times the wavelength of radio waves for use in the communication, independent polarized waves as mentioned above are used. Also in the case of performing long-distance communication such that a transmitting antenna and a receiving antenna are spaced apart from each other by a long distance sufficiently larger than the above wavelength, independent polarized waves as mentioned above are used.

Such short-distance communication is applied to a noncontact type IC card, for example, without the use of a connector or the like for electrical connection, and a high communication speed is desired with the feature missing in the long-distance communication.

SUMMARY

It is desirable to provide a radio communication system and a communication method therefor which can realize a communication speed higher than that in the communication method in related art using two-dimensional orthogonal polarized waves.

In accordance with an embodiment, there is provided a radio communication system for performing radio communication between a first antenna and a second antenna, wherein the first antenna includes a plurality of antenna elements for forming polarization planes orthogonal to each other in three-axial directions; the second antenna includes a plurality of antenna elements for forming polarization planes orthogonal to each other in the three-axial directions; the first antenna and the second antenna are arranged so that the polarization planes formed by the antenna elements of the first antenna are respectively opposed to the polarization planes formed by the antenna elements of the second antenna; and the communication between the first antenna and the second antenna is performed by using three independent polarized waves.

In accordance with another embodiment, there is provided a communication method for a radio communication system for performing radio communication between a first antenna and a second antenna each having a plurality of antenna elements for forming polarization planes orthogonal to each other in three-axial directions, comprising the steps of arranging the first antenna and the second antenna so that the polarization planes formed by the antenna elements of the first antenna are respectively opposed to the polarization planes formed by the antenna elements of the second antenna; and performing the communication between the first antenna and the second antenna by using three independent polarized waves.

According to an embodiment, each of the first and second antennas includes a plurality of antenna elements formed in the three-axial directions in the condition where the polarization planes formed by the antenna elements of each antenna are orthogonal to each other. Further, the first and second antennas are arranged so that the polarization planes formed by the antenna elements of the first antenna are respectively opposed to the polarization planes formed by the antenna elements of the second antenna. Accordingly, the communication between the first and second antennas can be performed by using three independent polarized waves having the same frequency, thereby increasing the communication speed.

Additional features and advantages are described herein, and will be apparent from, the following Detailed Description and the figures.

DETAILED DESCRIPTION

Preferred embodiments will now be described in detail with reference to the drawings.

Figure 1:
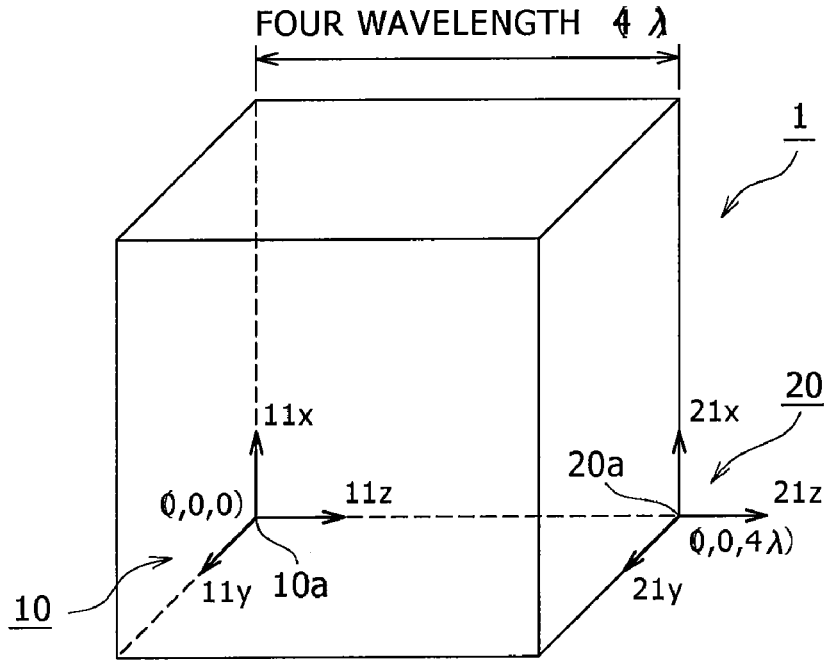
FIGS. 1 to 4 are schematic perspective views showing various arrangements of a transmitting antenna and a receiving antenna.
Figure 2:
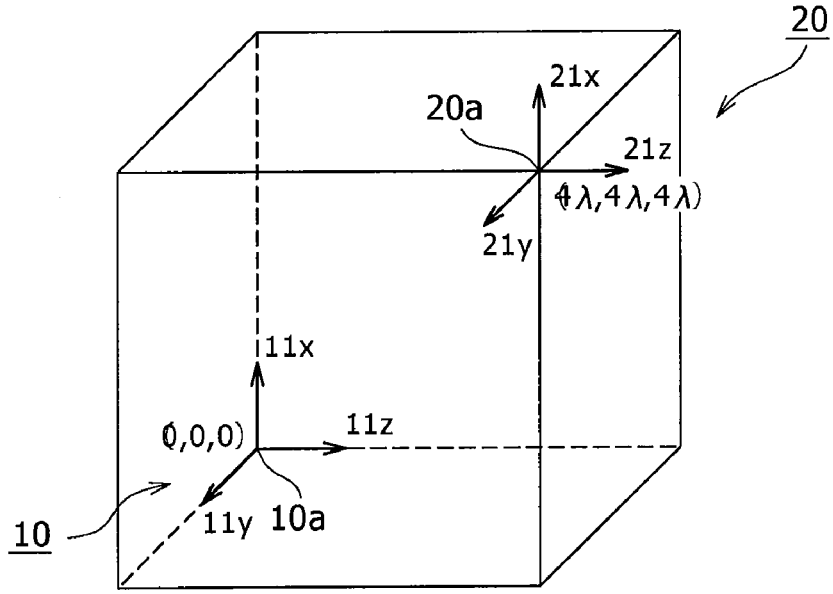
Figure 3:
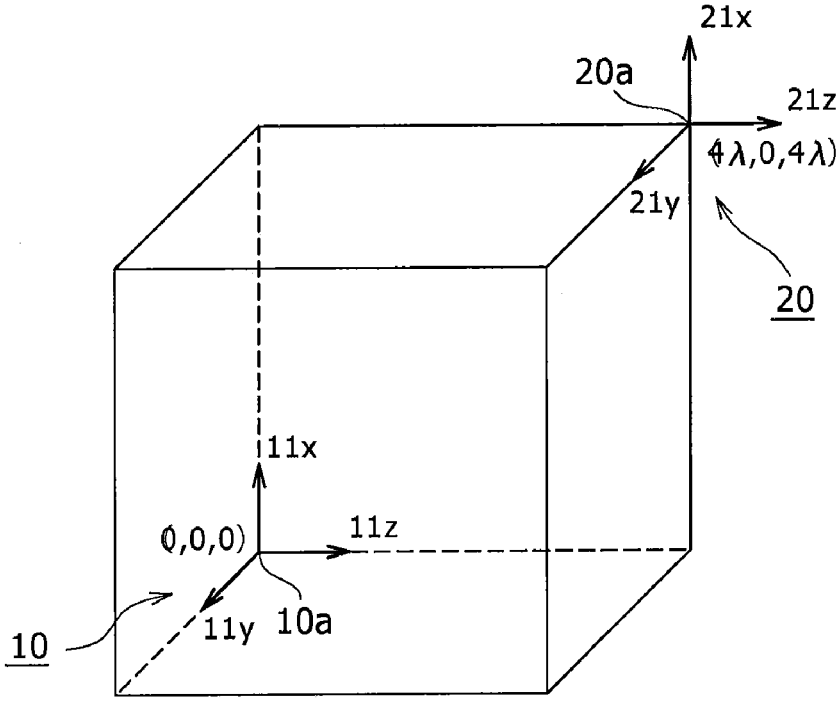

The configuration and operation of a radio communication system 1 according to the preferred embodiment will first be described. The radio communication system 1 includes a transmitting antenna 10 and a receiving antenna 20 both located in an orthogonal three-dimensional coordinate system formed by X, Y, and Z axes as shown in FIGS. 1 to 3, in which signal transmission is performed between these antennas 10 and 20.

The transmitting antenna 10 includes transmitting elements 11*x*, 11*y*, and 11*z* respectively extending from a center point 10*a* in the directions of the X, Y, and Z axes (which transmitting elements 11*x*, 11*y*, and 11*z* will be hereinafter referred to generically as transmitting elements 11 unless otherwise specified). Each transmitting element 11 is a directional antenna element such as a dipole antenna. In the case of using a dipole antenna as each transmitting element 11, the transmitting element 11*x* forms a polarization plane in the radial directions about the X axis, the transmitting element 11*y* forms a polarization plane in the radial directions about the Y axis, and the transmitting element 11*z* forms a polarization plane in the radial directions about the Z axis. Accordingly, the transmitting antenna 10 forms three polarization planes orthogonal to each other, so that the transmitting antenna 10 can transmit three independent polarized waves.

The three transmitting elements 11 radiate radio waves having the same frequency. Accordingly, the transmitting antenna 10 can employ the antenna elements having the same characteristics, and it is unnecessary to provide a plurality of carrier wave generating circuits for different frequencies. Generally, in the case of using a plurality of independent polarized waves to perform communication, radio waves having the same frequency are used because of the above-mentioned advantage.

The propagation components of the radio waves radiated from the transmitting elements 11*x*, 11*y*, and 11*z* are converged to zero toward the extensions of the X axis, the Y axis, and the Z axis, respectively, from the viewpoint of antenna characteristics. Thus, each transmitting element 11 cannot radiate the radio wave toward the extension of the longitudinal direction thereof.

The receiving antenna 20 includes receiving elements 21*x*, 21*y*, and 21*z* respectively extending from a center point 20*a* in the directions of the X, Y, and Z axes (which receiving elements 21*x*, 21*y*, and 21*z* will be hereinafter referred to generically as receiving elements 21 unless otherwise specified). Each receiving element 21 is a directional antenna element such as a dipole antenna. In this preferred embodiment, the receiving element 21*x* forms a polarization plane in the radial directions about the X axis, the receiving element 21*y* forms a polarization plane in the radial directions about the Y axis, and the receiving element 21*z* forms a polarization plane in the radial directions about the Z axis. Accordingly, the receiving antenna 20 forms three polarization planes orthogonal to each other, so that the receiving antenna 20 can receive three independent polarized waves. Further, the three receiving elements 21 radiate radio waves having the same frequency.

The propagation components of the radio waves radiated from the receiving elements 21$x$, 21$y$, and 21$z$ are converged to zero toward the extensions of the X axis, the Y axis, and the Z axis, respectively, from the viewpoint of antenna characteristics. Thus, each receiving element 21 cannot receive the radio wave propagating from the extension of the longitudinal direction thereof.

There will now be described communication sensitivity in the case that the transmitting antenna 10 and the receiving antenna 20 are located in different positional relations as shown in FIGS. 1 to 3 in the orthogonal three-dimensional coordinate system formed by the X, Y, and Z axes. In this preferred embodiment, attention is focused on short-distance communication such that the distance between the transmitting antenna 10 and the receiving antenna 20 is set to a distance several times the wavelength of radio waves for use in the communication, and the purpose is to attain a high communication speed between the transmitting antenna 10 and the receiving antenna 20.

In the positional relation shown in FIG. 1, the position of the transmitting antenna 10 is set at the origin (0, 0, 0), and the position of the receiving antenna 20 is set to a position spaced apart from the origin by a distance several times the wavelength λ, e.g., 4λ. In this case, the receiving antenna 20 is set at the position (0, 0, 4λ). The longitudinal direction of the transmitting element 11$x$ is parallel to the longitudinal direction of the receiving element 21$x$. Further, the longitudinal direction of the transmitting element 11$y$ is parallel to the longitudinal direction of the receiving element 21$y$. Accordingly, the polarization planes formed by the transmitting element 11$x$ and the receiving element 21$x$ are opposed to each other, and the polarization planes formed by the transmitting element 11$y$ and the receiving element 21$y$ are opposed to each other, so that communication can be performed by two independent polarized waves. However, since the transmitting element 11$z$ and the receiving element 21$z$ extend on the same straight line, communication cannot be performed between the transmitting element 11$z$ and the receiving element 21$z$.

In the positional relation shown in FIG. 2, the position of the transmitting antenna 10 is set at the origin (0, 0, 0), and the position of the receiving element 20 is set to a position (4λ, 4λ, 4λ). In this case, the longitudinal directions of the transmitting elements 11$x$, 11$y$, and 11$z$ are parallel to the longitudinal directions of the receiving elements 21$x$, 21$y$, and 21$z$, respectively, so that communication can be performed by three independent polarized waves.

In the positional relation shown in FIG. 3, the position of the transmitting antenna 10 is set at the origin (0, 0, 0), and the position of the receiving antenna 20 is set to a position (4λ, 0, 4λ). Also in this case, the longitudinal directions of the transmitting elements 11$x$, 11$y$, and 11$z$ are parallel to the longitudinal directions of the receiving elements 21$x$, 21$y$, and 21$z$, respectively, so that communication can be performed by three independent polarized waves.

Figure 14:
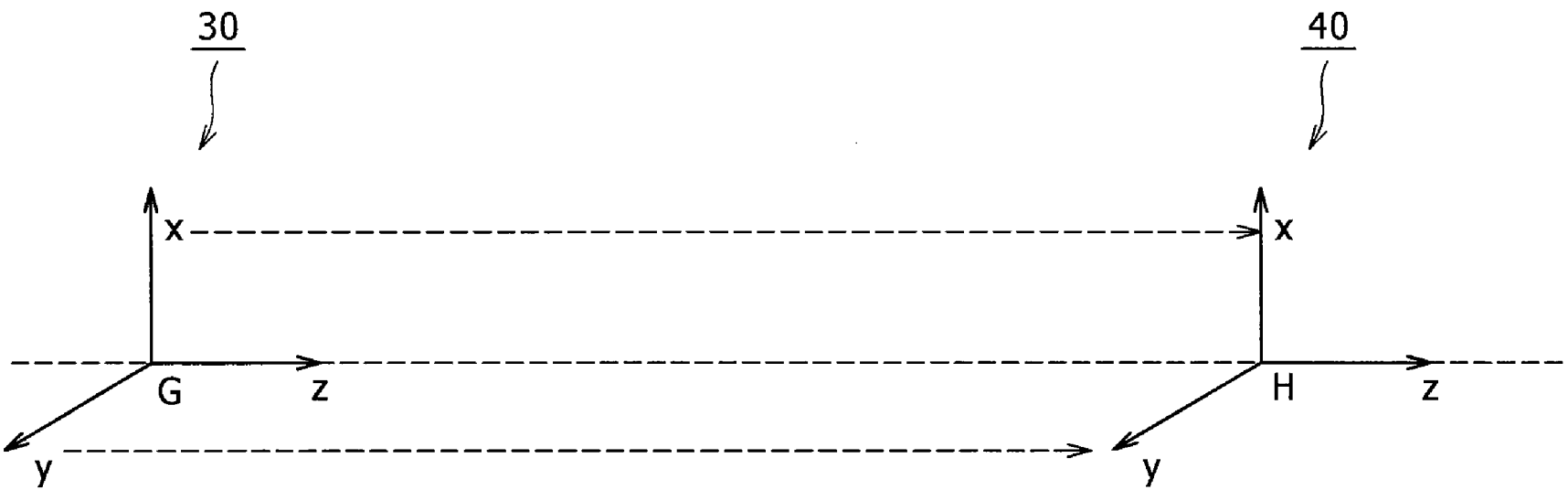
FIG. 14 is a schematic perspective view showing the arrangement of a transmitting antenna and a receiving antenna in the related art.

Accordingly, assuming that information can be transmitted at a data rate of k [bps] by using one polarized wave, the data rate in the radio communication system 1 shown in FIG. 1 or in the radio communication system in related art shown in FIG. 14 becomes 2 k [bps]. In contrast, the data rate in the radio communication system 1 shown in FIG. 2 or 3 becomes 3 k [bps].

Accordingly, in the arrangement of the transmitting antenna 10 and the receiving antenna 20 shown in FIG. 2 or 3, the number of communication channels can be increased by one as compared with the antenna arrangement in related art, thereby increasing the communication speed in the radio communication system 1.

In the antenna arrangement shown in FIG. 1, the transmitting element 11$z$ and the receiving element 21$z$ extend on the same straight line, so that communication cannot be performed between the transmitting element 11$z$ and the receiving element 21$z$. However, by using a reflecting element on the plane orthogonal to the X axis, i.e., the YZ plane, the polarization planes formed by the transmitting element 11$z$ and the receiving element 21$z$ can be opposed to each other, thereby allowing the communication by the use of three different polarized waves.

Figure 4:
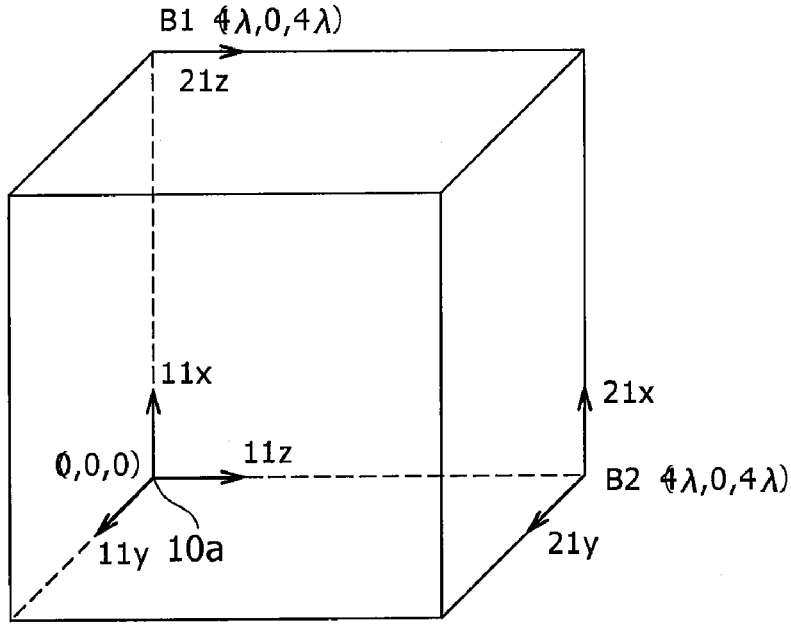

Further, in considering the arrangement of the transmitting antenna 10 and the receiving antenna 20 allowing the communication by the use of three different polarized waves, the individual antenna elements may be set at different positions. For example, as shown in FIG. 4, the position of the transmitting antenna 10 is set at the origin (0, 0, 0) in the XYZ coordinate system, and the position of the receiving antenna 20 is set so that the position of the receiving element 21$z$ is set to a position B1 (4λ, 0, 0) and the position of each of the receiving elements 21$x$ and 21$y$ is set to a position B2 (0, 0, 4λ). Also in this case, the longitudinal directions of the receiving elements 21$x$, 21$y$, and 21$z$ are parallel to the longitudinal directions of the transmitting elements 11$x$, 11$y$, and 11$z$, respectively, so that communication can be performed at a data rate of 3 k [bps] in the radio communication system 1.

Figure 5A:
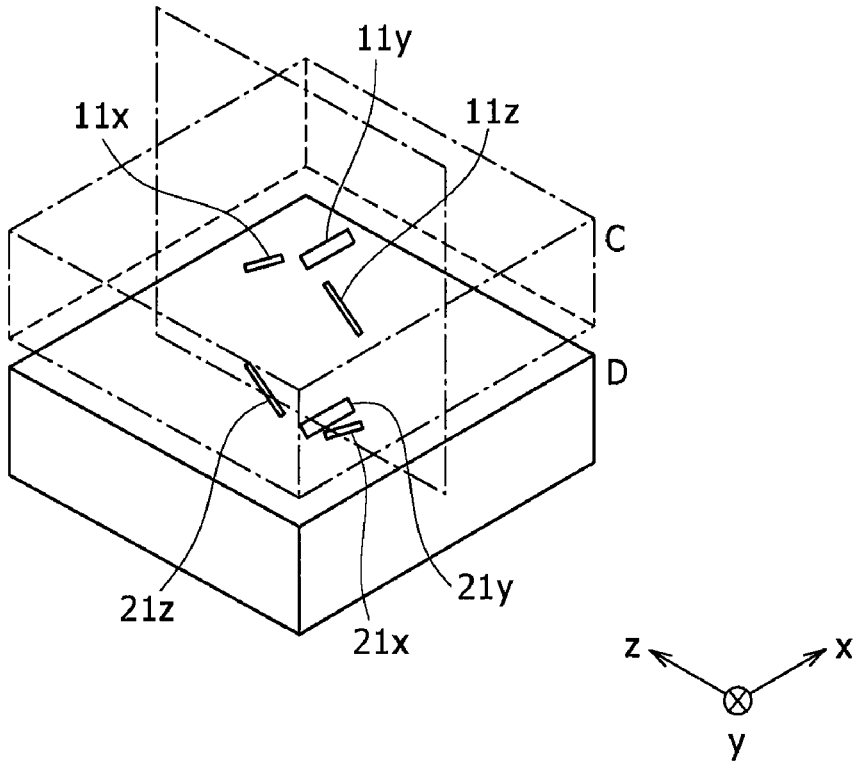
FIG. 5A is a schematic perspective view showing a different arrangement of a transmitting antenna and a receiving antenna.
Figure 5B:
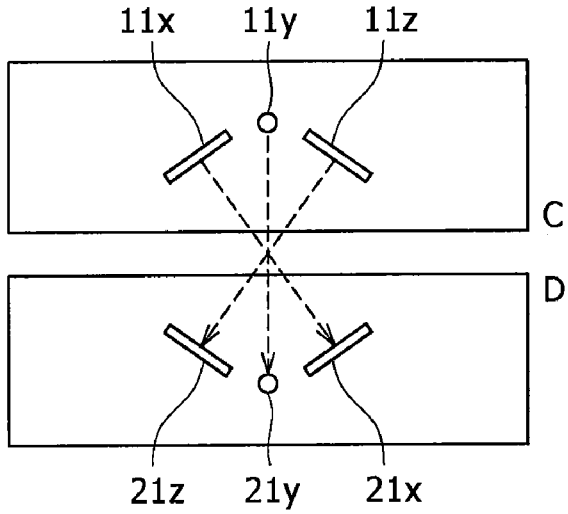
FIG. 5B is a sectional view of two devices respectively containing the transmitting antenna and the receiving antenna as taken in a direction perpendicular to a C-D layer formed between these devices.

Further, the transmitting antenna 10 and the receiving antenna 20 may be arranged as shown in FIG. 5A. The arrangement shown in FIG. 5A is obtained by 180° rotating the receiving elements 21$x$ and 21$z$ about the receiving element 21$y$ as the axis of rotation in the condition where the transmitting antenna 10 shown in FIG. 3 is fixed in position and attitude. In this 180° rotated state, in the radio communication system 1, as shown in FIG. 5B which is a cross section perpendicular to the longitudinal directions of the transmitting element 11$y$ and the receiving element 21$y$, the longitudinal direction of the transmitting element 11$x$ becomes parallel to the longitudinal direction of the receiving element 21$x$, thereby allowing the communication between the transmitting element 11$x$ and the receiving element 21$x$. Further, in the radio communication system 1, the longitudinal directions of the receiving elements 21$y$ and 21$z$ are parallel to the longitudinal directions of the transmitting elements 11$y$ and 11$z$, respectively, thereby allowing the communication between the transmitting elements 11$y$ and 11$z$ and the receiving elements 21$y$ and 21$z$ by using two polarized waves whose polarization planes are orthogonal to each other.

Figure 6:
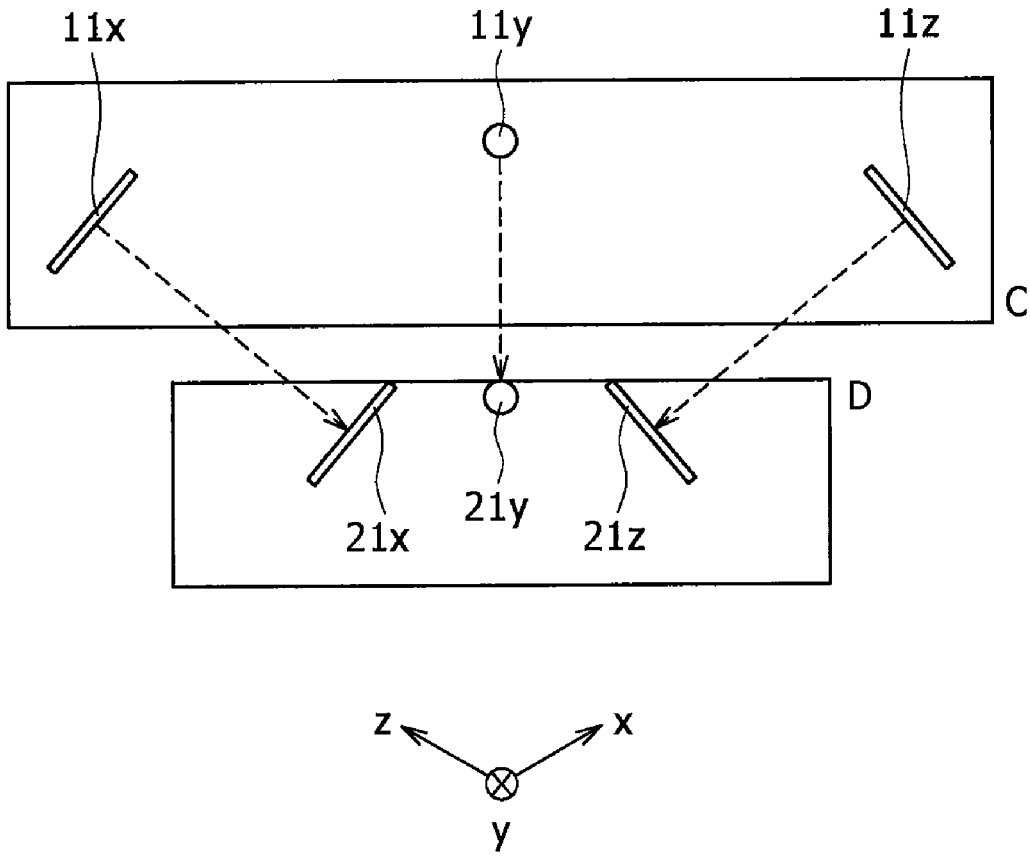
FIG. 6 is a view similar to FIG. 5B, showing a modification of the arrangement of the transmitting antenna and the receiving antenna.

FIG. 6 shows a modification of the arrangement shown in FIG. 5B. This modification also allows the communication by the use of three independent polarized waves. This modification is obtained by 180° rotating the receiving antenna 20 shown in FIG. 5B about the longitudinal direction of the receiving element 21$y$ as the axis of rotation and displacing the receiving element 21$y$ toward the transmitting element 11$y$. Furthermore, to make the longitudinal directions of the transmitting elements 11$x$ and 11$z$ parallel to the longitudinal directions of the receiving elements 21$x$ and 21$z$, respectively, the transmitting elements 11$x$ and 11$z$ are translated in the opposite directions perpendicular to the propagation direction of radio waves from the transmitting element 11$y$ to the receiving element 21$y$. With this arrangement, communication can be performed in the radio communication system 1 by using three independent polarized waves.

In the case that the transmitting antenna 10 and the receiving antenna 20 are arranged so as to be spaced apart from each other by a distance several times, e.g. four times in this embodiment, the wavelength of radio waves in the condition where the respective antenna elements are arranged in various positions and attitudes as mentioned above, communication can be performed in a three-dimensional orthogonal coordinate system by using three independent polarized waves.

However, although the antenna elements of each antenna are arranged in position and attitude along the three independent orthogonal axes in the condition where the transmitting and receiving antennas 10 and 20 are spaced apart from each other by a distance several times the wavelength, the receiving antenna 20 receives a plurality of polarized wave components, which interfere with each other. Such interference causes an error in receiving communication data, and it is therefore desirable to remove the interference.

Figure 7:
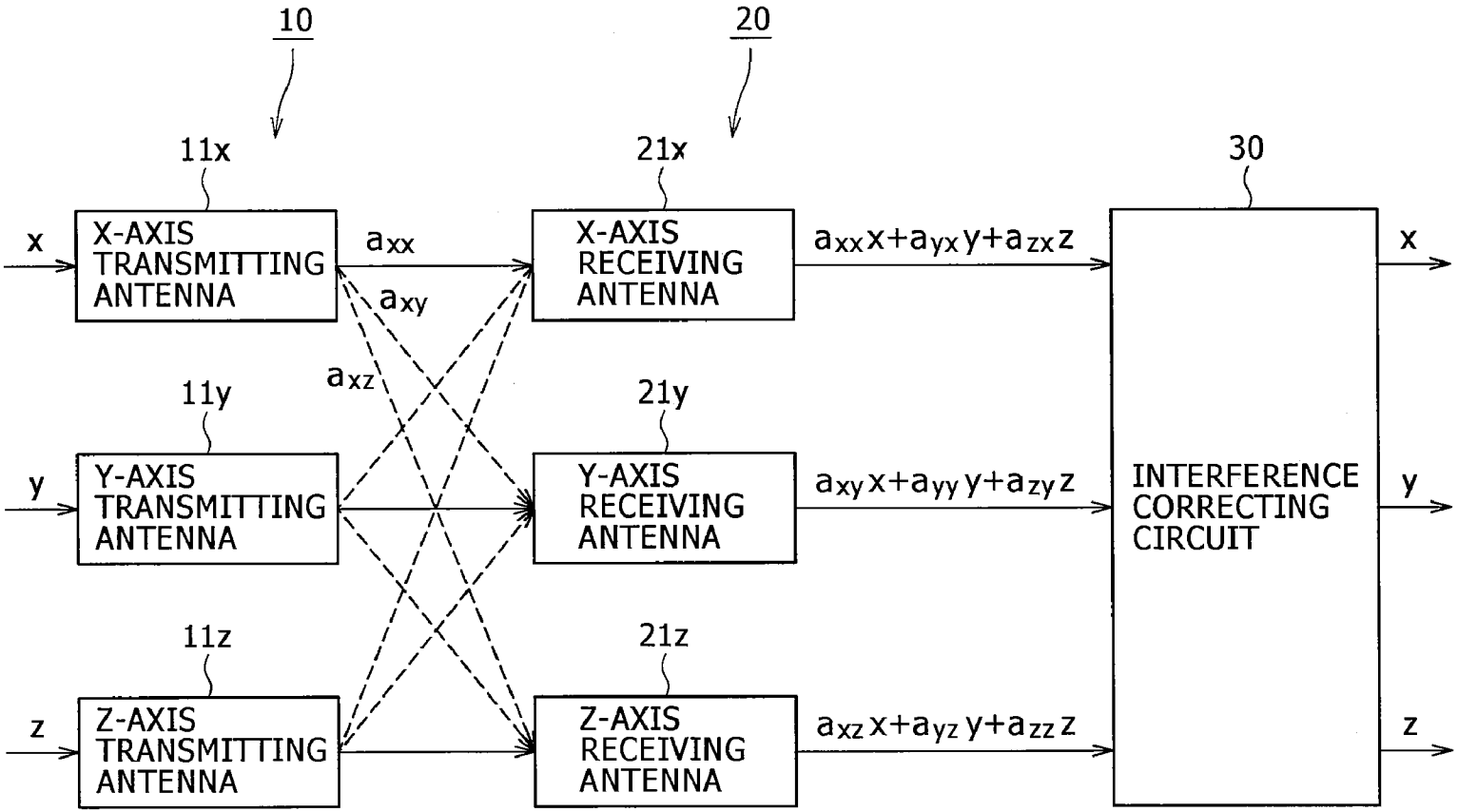
FIG. 7 is a block diagram showing the configuration and operation of an interference correcting circuit.

Accordingly, the radio communication system 1 includes an interference correcting circuit 30 for correcting for the interference between polarized waves having different polarization planes as shown in FIG. 7 in addition to the transmitting antenna 10 and the receiving antenna 20.

As shown in FIG. 7, the interference correcting circuit 30 is supplied with three signals respectively received from the receiving elements 21*x*, 21*y*, and 21*z* of the receiving antenna 20, and corrects these three signals to output corrected signals reduced in effect of the interference. Before starting the transmission of actual communication signals between the transmitting antenna 10 and the receiving antenna 20, a known signal pattern is transmitted from the transmitting antenna 10 to the receiving antenna 20. The interference correcting circuit 30 determines parameters required for the correction based on the signal pattern.

For example, it is assumed that different polarized waves are transmitted from the transmitting antenna 10 in the order of (transmitting element 11*x*)→(transmitting element 11*y*)→(transmitting element 11*z*) according to the known signal pattern. In this case, it can be determined that the receiving antenna 20 has first received a signal from the transmitting element 11*x* according to the known signal pattern. The interference correcting circuit 30 calculates correction parameters $a_{xx}$, $a_{xy}$, and $a_{xz}$ respectively for the receiving elements 21*x*, 21*y*, and 21*z* according to the signal transmitted from the transmitting element 11*x*. Similarly, the interference correcting circuit 30 calculates correction parameters according to the signals transmitted from the transmitting element 11*y* and the transmitting element 11*z*. Accordingly, even when three polarized waves are simultaneously transmitted from the transmitting antenna 10, the interference correcting circuit 30 corrects for the interference according to the correction parameters calculated above, thereby outputting corrected signals reduced in effect of the interference.

According to the radio communication system 1 including the interference correcting circuit 30, the probability of erroneous reception of communication data by the receiving antenna 20 can be reduced as compared with the case that the interference between the propagation components of polarized waves is not corrected. As a result, the reliability of communication can be improved.

While the interference correcting circuit 30 is provided on the receiving side in this preferred embodiment, an interference correcting circuit for generating signals for use in the correction for the interference between polarized waves may be provided on the transmitting side.

Figure 8A:
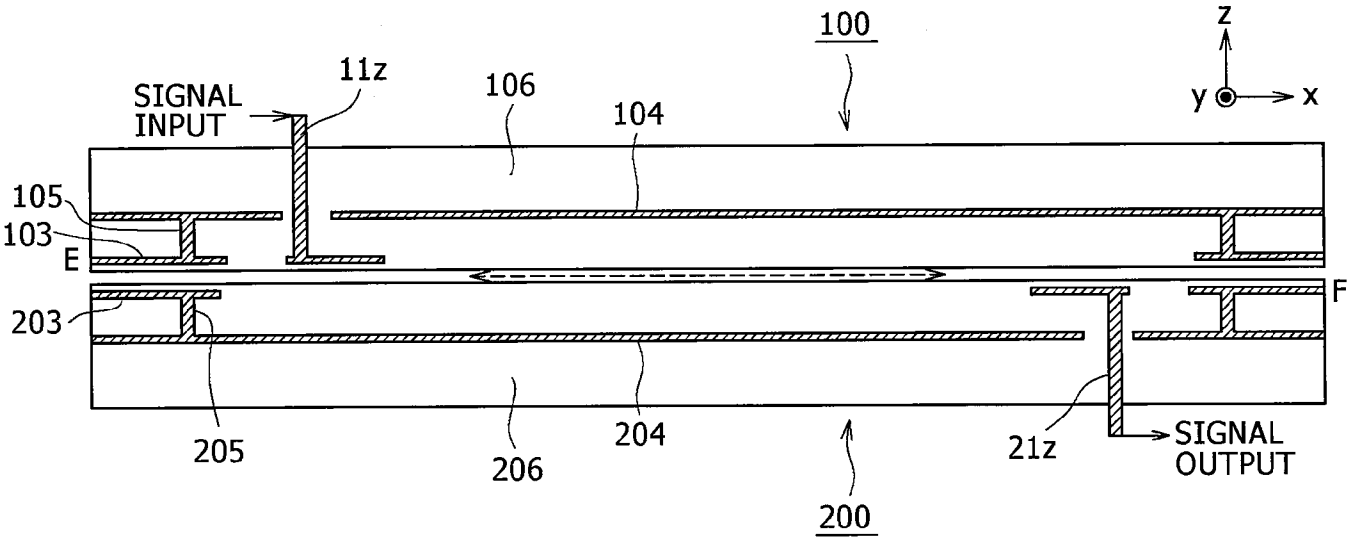
FIG. 8A is a sectional view of two devices respectively containing a transmitting antenna and a receiving antenna as taken in a direction perpendicular to an E-F layer formed between these devices in the case that the contact surfaces of these devices are flat.
Figure 8B:
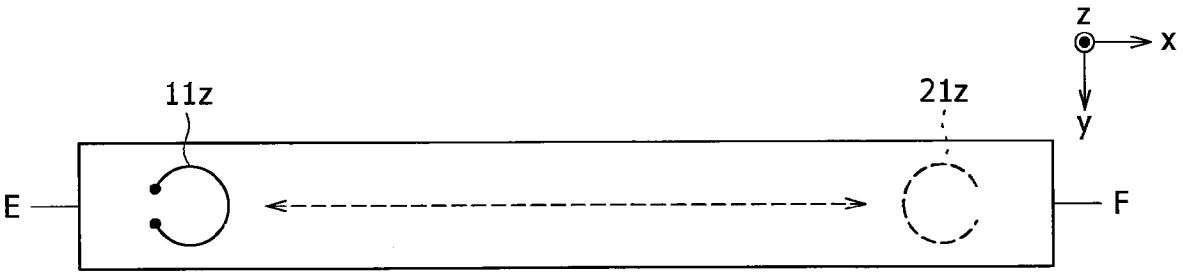
FIG. 8B is a plan view of FIG. 8A, showing the arrangement of Z-axis antenna elements.

Referring next to FIGS. 8A and 8B, there is shown a specific example of the radio communication system 1 according to this preferred embodiment. As shown in FIGS. 8A and 8B, the transmitting antenna 10 is embedded in a surface portion of a device 100, and the receiving antenna 20 is embedded in a surface portion of a device 200.

More specifically, the transmitting antenna 10 embedded in the device 100 is configured in such a manner that the transmitting elements 11*x* and 11*y* are slot antennas and the transmitting element 11*z* is a loop antenna. Similarly, the receiving antenna 20 embedded in the device 200 is configured in such a manner that the receiving elements 21*x* and 21*y* are slot antennas and the receiving element 21*z* is a loop antenna. The device 100 functions to transmit a predetermined signal through each transmitting element 11 to the device 200, and the device 200 functions to receive the signal transmitted from the device 100 through each receiving element 21.

In the case that each transmitting element 11 and each receiving element 21 are realized by dipole antennas, the three transmitting elements 11 respectively extend along the three orthogonal axes, and the three receiving elements 21 respectively extend along the three orthogonal axes. Accordingly, the transmitting elements 11*x*, 11*y*, and 11*z* extend parallel to the receiving elements 21*x*, 21*y*, and 21*z*, respectively, so that communication can be performed between the transmitting antenna 10 and the receiving antenna 20 by using three independent polarized waves. To the contrary, in the configuration shown in FIGS. 8A and 8B, the transmitting elements 11 and the receiving elements 21 are realized by loop antennas and slot antennas different in property from each other. Accordingly, the arrangement of the transmitting elements 11 and the receiving elements 21 requires conditions different from those in the case of using dipole antennas. However, communication can be performed by three independent polarized waves by setting the transmitting antenna 10 and the receiving antenna 20 in such a manner that the transmitting elements 11 form three orthogonal polarization planes, that the receiving elements 21 form three orthogonal polarization planes, and that the three orthogonal polarization planes formed by the transmitting elements 11 are respectively opposed to the three orthogonal polarization planes formed by the receiving elements 21.

If the above conditions for the arrangement of the antenna elements are met, any antenna elements other than the dipole antennas, the loop antennas, and the slot antennas mentioned above may be used to allow the communication by the use of three independent polarized waves.

The arrangement of the transmitting elements 11 and the receiving elements 21 shown in FIGS. 8A and 8B will now be described more specifically.

The transmitting element 11*z* embedded in the device 100 and the receiving element 21*z* embedded in the device 200 are arranged in the following manner.

FIG. 8A is a sectional view of the device 100 and the device 200 set in such a manner that a surface E of the device 100 is in contact with a surface F of the device 200. The surfaces E and F lie in the XY planes. As shown in FIG. 8A, the surface portion of the device 100 includes ground layers 103 and 104 forming a dual-layer structure, a through hole 105 connecting the ground layers 103 and 104, and a dielectric region 106 as the remaining portion. The transmitting element 11*z* is located in a region surrounded by the ground layers 103 and 104 and the through hole 105.

Similarly, the surface portion of the device 200 includes ground layers 203 and 204 forming a dual-layer structure, a through hole 205 connecting the ground layers 203 and 204, and a dielectric region 206 as the remaining portion. The receiving element 21*z* is located in a region surrounded by the ground layers 203 and 204 and the through hole 205.

Radio wave transmitted from the transmitting element 11z propagates in an E-F layer formed between the surface E of the device 100 and the surface F of the device 200 and is received by the receiving element 21z. The ground layer 103 of the device 100 and the ground layer 203 of the device 200 prevent the propagation of radio wave in any regions other than the region ranging from the transmitting element 11z to the receiving element 21z, thereby suppressing a possibility that the radio wave transmitted from the transmitting element 11z may be received by any receiving elements other than the receiving element 21z.

FIG. 8B is a plan view of the device 100 as viewed in a direction perpendicular to the E-F layer, i.e., in the direction of the Z axis. The polarization planes formed by the transmitting element 11z and the receiving element 21z lie in the XY planes opposed to each other. Accordingly, communication is performed by the radio wave propagating in a direction perpendicular to the surfaces E and F, i.e., in the direction of the Z axis.

Figure 9:
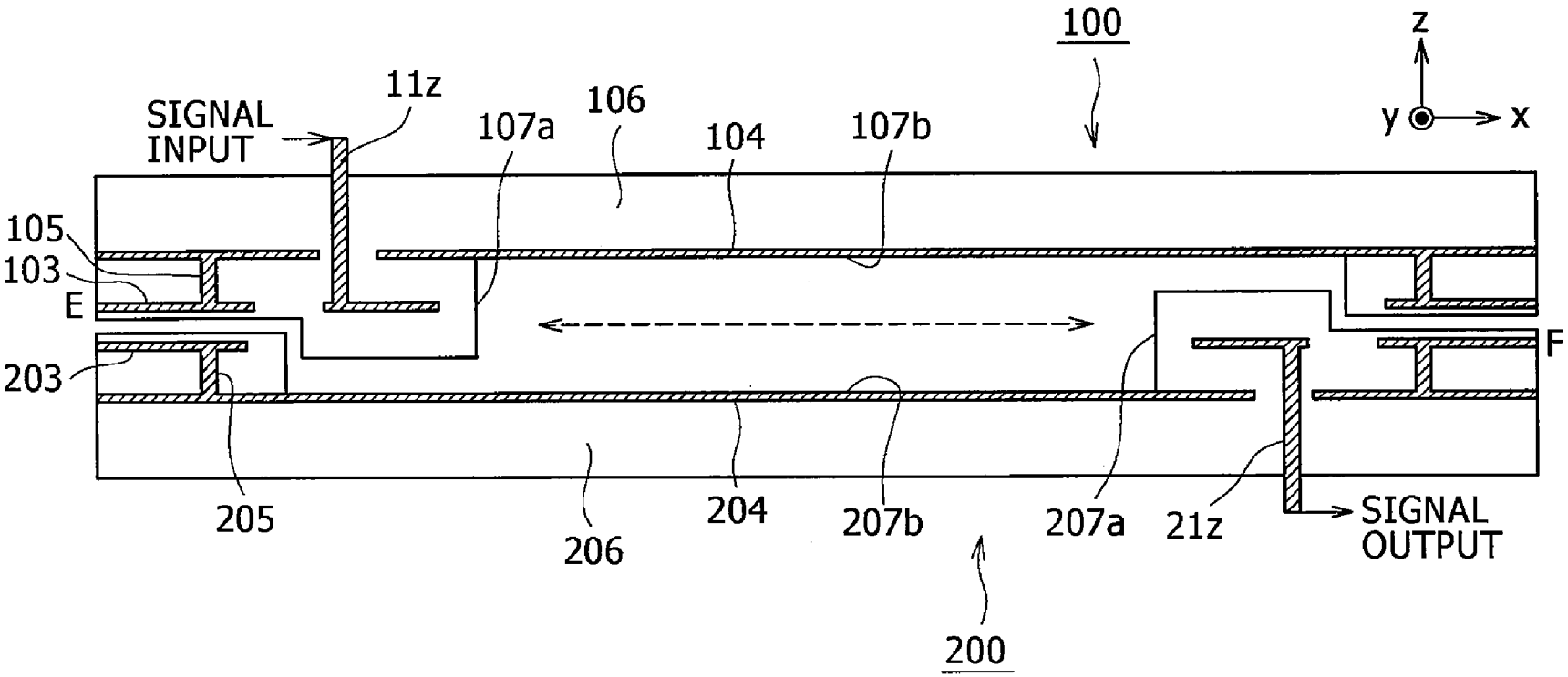
FIG. 9 is a view similar to FIG. 8A, showing a modification such that the contact surface of the devices are formed with projections and recesses engageable with each other.

FIG. 9 shows a modification of the configuration shown in FIGS. 8A and 8B. In this modification, the contact surfaces E and F of the devices 100 and 200 are projected and recessed. More specifically, the surface E of the device 100 containing the transmitting element 11z is formed with a projection 107a, and the surface F of the device 200 containing the receiving element 21z is formed with a projection 207a. Further, the surface E of the device 100 is formed with a recess 107b engageable with the projection 207a of the device 200, and the surface F of the device 200 is formed with a recess 207b engageable with the projection 107a of the device 100. The recess 107b of the device 100 is formed by removing the dielectric region 106 formed between the ground layer 103 and the ground layer 104. Similarly, the recess 207b of the device 200 is formed by removing the dielectric region 206 formed between the ground layer 203 and the ground layer 204. The portion surrounding these recesses 107b and 207b is formed with the ground layers 103 and 104 having a dual-layer structure and the ground layers 203 and 204 having a dual-layer structure. Accordingly, the leakage of the radio wave radiated from the transmitting element 11z out of the surrounding portion can be suppressed.

Thus, the surface E of the device 100 has the projection 107a and the recess 107b, and the surface F of the device 200 has the projection 207a and the recess 207b respectively engageable with the recess 107b and the projection 107a of the device 100 as mentioned above. Accordingly, the devices 100 and 200 can be easily aligned to each other. Further, the engaged portion ranging from the projection 107a at which the transmitting element 11z is located to the projection 207a at which the receiving element 21z is located has no dielectric region. Accordingly, as compared with the configuration shown in FIGS. 8A and 8B, a dielectric loss produced during the propagation of radio wave from the transmitting element 11z to the receiving element 21z can be reduced to thereby improve the communication sensitivity between each transmitting element 11 and each receiving element 21.

Figure 10:
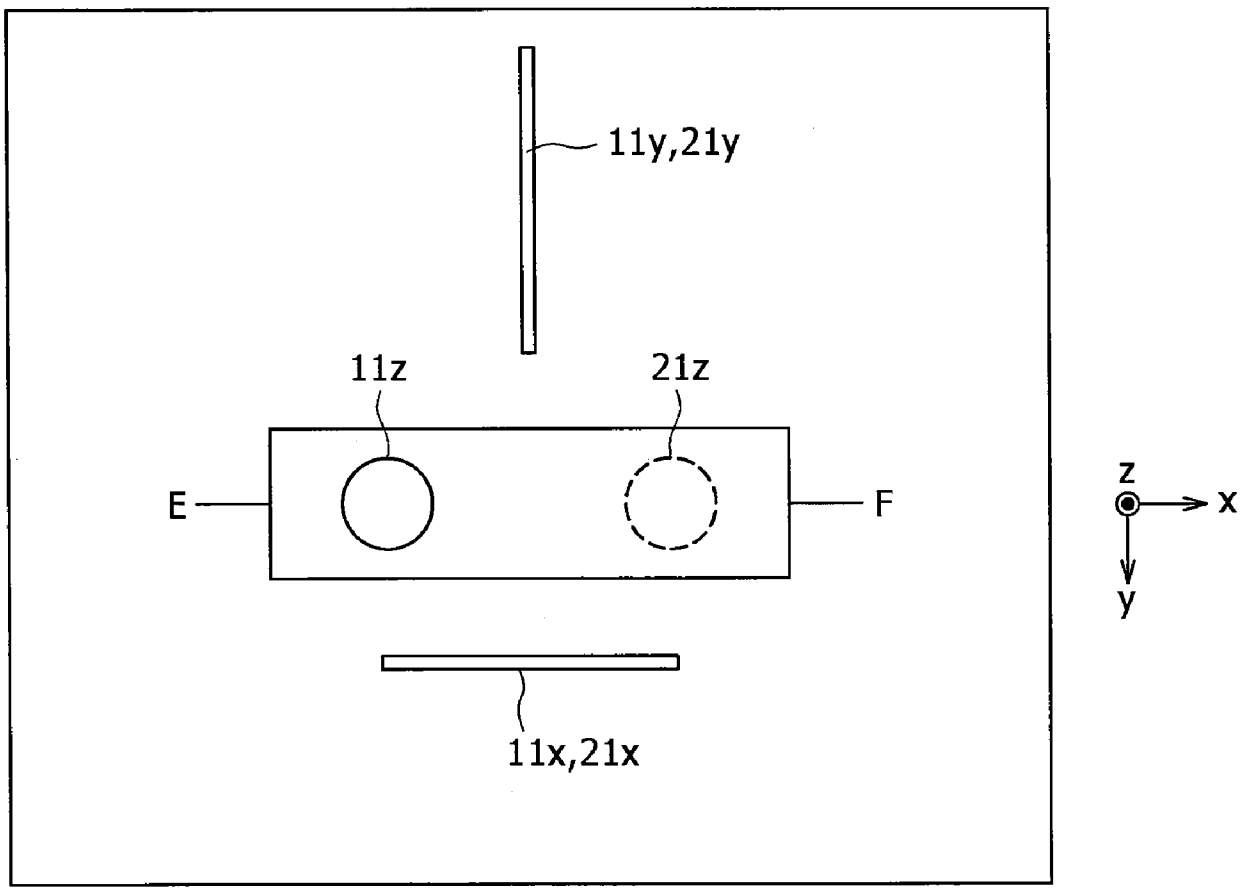
FIG. 10 is a plan view corresponding to FIG. 8B, showing the arrangement of X-axis antenna elements and Y-axis antenna elements.

The arrangement of the other transmitting elements 11x and 11y and the other receiving elements 21x and 21y in the configuration shown in FIGS. 8A and 8B will now be described with reference to FIG. 10. As similar to FIG. 8B, FIG. 10 is a plan view of the device 100 as viewed in a direction perpendicular to the E-F layer, i.e., in the direction of the Z axis.

The transmitting elements 11x and 11y extend parallel to the surface E of the device 100. Further, the longitudinal directions of the transmitting elements 11x and 11y are perpendicular to each other.

Similarly, the receiving elements 21x and 21y extend parallel to the surface E of the device 100. Further, the receiving elements 21x and 21y are opposed to the transmitting elements 11x and 11y, respectively. In the configuration shown in FIG. 10, the receiving elements 21x and 21y are positioned in superimposed relationship with the transmitting elements 11x and 11y, respectively.

The magnetic fields formed by the loop type transmitting element 11z and the loop type receiving element 21z are perpendicular to the contact surfaces E and F of the devices 100 and 200, i.e., perpendicular to the XY plane. The polarization planes formed by the transmitting element 11x and the receiving element 21x are opposed to the XY plane. The polarization planes formed by the transmitting element 11y and the receiving element 21y are orthogonal to the polarization plane formed by the transmitting element 11x and opposed to the XY plane.

As mentioned above, the transmitting antenna 10 and the receiving antenna 20 are embedded in the device 100 and the device 200, respectively, thereby allowing the communication between the devices 100 and 200 by using three independent polarized waves.

While the receiving elements 21x and 21y are positioned in superimposed relationship with the transmitting elements 11x and 11y, respectively, in FIG. 10, the positions of the receiving elements 21x and 21y relative to the transmitting elements 11x and 11y are not limited to the above. It is sufficient that the longitudinal direction of the receiving element 21x be parallel to the longitudinal direction of the transmitting element 11x except that the transmitting element 11x and the receiving element 21x extend on the same straight line. Further, it is sufficient that the longitudinal direction of the receiving element 21y be parallel to the longitudinal direction of the transmitting element 11y except that the transmitting element 11y and the receiving element 21y extend on the same straight line. For example, the receiving element 21x may be translated in the direction of the Y axis, and the receiving element 21y may be translated in the direction of the Z axis. Also in this case, the polarization planes formed by the transmitting element 11x and the receiving element 21x are opposed to each other, and the polarization planes formed by the transmitting element 11y and the receiving element 21y are opposed to each other. Accordingly, communication can be performed by three independent polarized waves.

In this preferred embodiment, the three transmitting elements 11x, 11y, and 11z are embedded in the device 100, and the three receiving elements 21x, 21y, and 21z are embedded in the device 200, thereby performing one-way communication from the device 100 to the device 200. However, the configuration of the communication system is not limited above. For example, two transmitting elements and one receiving element may be included in the device 100, and one transmitting element and two receiving elements may be included in the device 200, thereby performing two-way communication between the device 100 and the device 200.

There will now be described some applications of the radio communication system 1 to information equipment or the like. In performing the communication by the use of three independent polarized waves, the distance between the transmitting antenna 10 and the receiving antenna 20 should be set to a distance several times the wavelength of radio waves. Accordingly, in the case of incorporating the device 100 and the device 200 in portable terminal equipment, the distance between the antennas should be set to several centimeters in view of the size of these devices and the portable terminal equipment.

More specifically, in the case that the distance between the antennas is about 20 mm and this distance corresponds to a distance four times the operating wavelength, the operating wavelength becomes about 5 mm. In the case of designing an antenna element according to this wavelength, the length of a dipole antenna element as an example of the antenna element becomes half of the wavelength, e.g., about 2.5 mm in the above case. Such a small-sized antenna element can be sufficiently built in portable terminal equipment or the like. Accordingly, one of the most suitable applications of the radio communication system 1 using three independent polarized waves is considered to be portable information equipment or the like.

In this application, it is assumed that the operating wavelength of polarized waves is set to about 5 mm, i.e., the communication frequency is set to 65 GHz to perform radio connection between separate pieces of equipment. As mentioned above, the communication between the device 100 and the device 200 may be one-way communication or two-way communication.

Figure 11A:
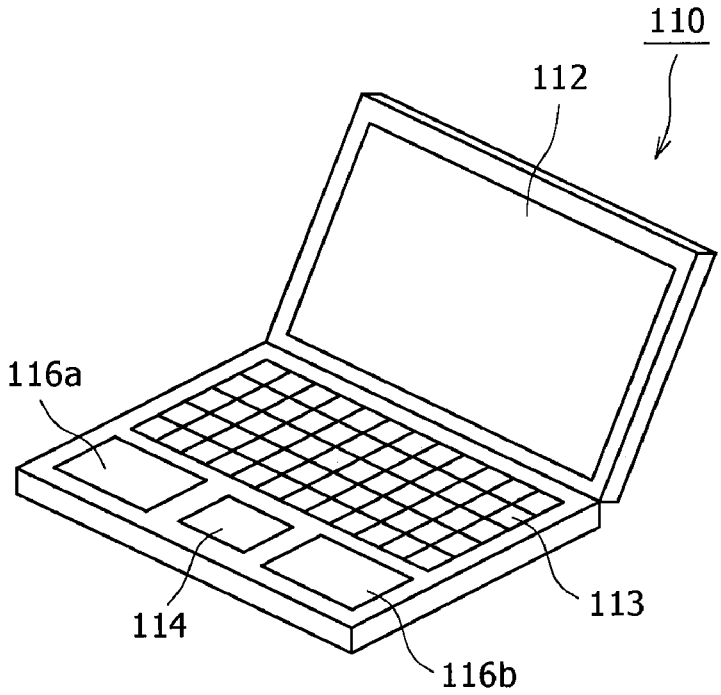
FIG. 11A is a perspective view of a notebook PC to which the present invention is applicable.
Figure 11B:
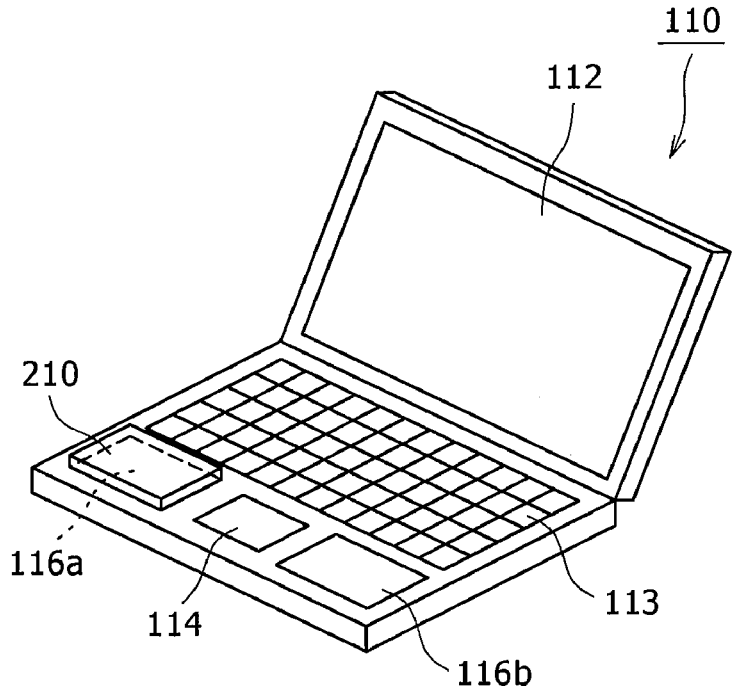
FIG. 11B is a perspective view showing the condition where portable terminal equipment including antenna elements is placed on the notebook PC shown in FIG. 11A.

FIGS. 11A and 11B show a first application wherein the device 100 is built in a notebook PC (Personal Computer) 110, and the device 200 is built in portable terminal equipment 210, thereby performing the communication between the device 100 and the device 200 respectively built in the separate pieces of equipment 110 and 210.

As shown in FIG. 11A, the notebook PC 110 includes a display 112, a keyboard 113, and a mouse pad 114. The device 100 is built in a surface portion of the notebook PC 110 at a position adjacent to the mouse pad 114. The portions formed on the right and left sides of the mouse pad 114 are flat portions where nothing is provided for the main purpose of allowing the user's hands to be put on in typing on the keyboard 113. For the convenience of illustration, the left portion formed on the left side of the mouse pad 114 to allow the user's left hand to be put on will be hereinafter referred to as a communication surface 116*a*, and the right portion formed on the right side of the mouse pad 114 to allow the user's right hand to be put on will be hereinafter referred to as a communication surface 116*b*. These communication surfaces 116*a* and 116*b* will be hereinafter referred to generically as communication surfaces 116 unless otherwise specified.

In performing the communication between the device 100 and the device 200 by using three independent polarized waves, the antenna elements embedded in the devices 100 and 200 should be accurately positioned. Such accurate positioning can be easily realized by forming projections and recesses engaging with each other on each communication surface 116 and the portable terminal equipment 210 as mentioned above with reference to FIG. 9. However, the communication surfaces 116 mainly function to allow the user's hands to be put on, and it is therefore undesirable to form the projections and the recesses mentioned above on the communication surfaces 116. Accordingly, although the communication surfaces 116 are flat, it is desirable to easily perform accurate positioning of the antenna elements.

In the example shown in FIG. 11B, when the portable terminal equipment 210 is placed on the communication surface 116*a*, a communication condition between the device 100 and the device 200 is measured by the notebook PC 110, and the result of measurement is displayed on the display 112. Further, the user performs optimum positioning of the portable terminal equipment 210 on the communication surface 116*a* according to the result displayed on the display 112. Thus, the user can easily perform accurate positioning of the devices 100 and 200 according to the visual information displayed on the display 112.

Figure 12A:
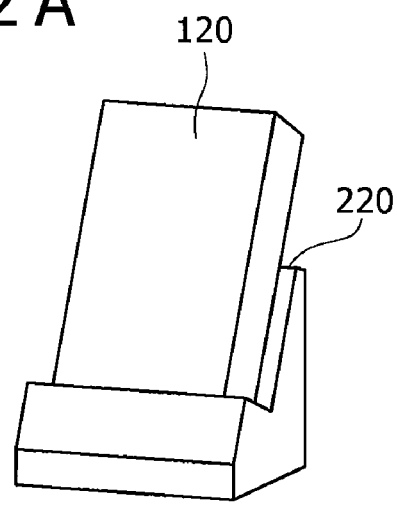
FIG. 12A is a perspective view of portable terminal equipment held in cradle equipment to which the present invention is applicable.
Figure 12B:
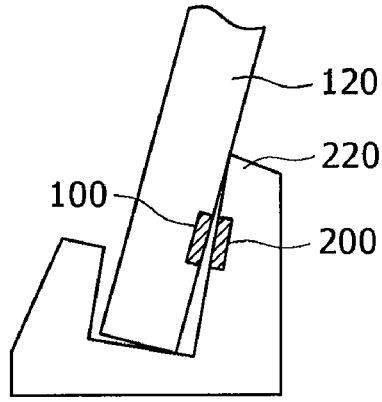
FIG. 12B is a vertical sectional view in the condition where the portable terminal is obliquely held in the cradle equipment.
Figure 12C:
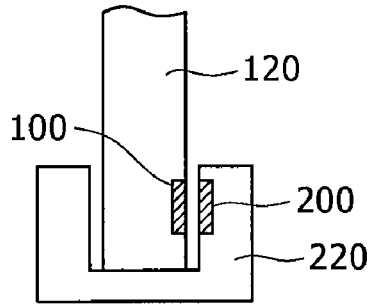
FIG. 12C is a view similar to FIG. 12B, showing a modification such that the portable terminal equipment is upright held in the cradle equipment.

FIGS. 12A to 12C show a second application wherein the device 100 is built in portable terminal equipment 120 such as a mobile phone and a PDA, and the device 200 is built in cradle equipment 220 for holding the portable terminal equipment 120.

The bottom of portable terminal equipment in related art is provided with a connector adapted to be electrically connected to cradle equipment. The cradle equipment is formed with a recess in which the portable terminal equipment is mountable. This recess has such a shape as to correspond to the periphery of the bottom of the portable terminal equipment, and the bottom of the recess of the cradle equipment is provided with a projecting connector adapted to be electrically connected to the connector of the portable terminal equipment. The connectors of the portable terminal equipment and the cradle equipment have a plug-in structure, so that the positions of the connectors are limited.

To the contrary, in the example shown in FIGS. 12A to 12C, the device 100 and the device 200 are connected by radio rather than by electrical connection using the connectors. Accordingly, it is not necessary to perform the connection and disconnection of the connectors, so that the limitation to the positions of the devices 100 and 200 can be relaxed to thereby increase the flexibility of design of the shape of equipment.

FIG. 12B is a sectional view showing a condition where the portable terminal equipment 120 is obliquely held by the cradle equipment 220 to perform radio connection between the device 100 and the device 200. FIG. 12C is a sectional view showing a condition where the portable terminal equipment 120 is upright held by the cradle equipment 220 to perform radio connection between the device 100 and the device 200. As shown in FIGS. 12B and 12C, the device 100 can be provided in a back portion of the portable terminal equipment 120, and the device 200 can be provided in a side portion of the cradle equipment 220 so as to be opposed to the device 100.

Further, the contact surfaces of the connectors of the portable terminal equipment in related art and the cradle equipment in related art are deteriorated with time, causing a reduction in reliability of communication. To the contrary, in the example shown in FIGS. 12A to 12C, the antenna elements are embedded in the devices 100 and 200 to perform radio connection between the portable terminal equipment 120 and the cradle equipment 220, so that there is no possibility of poor contact between the connectors as mentioned above.

There is a case that portable terminal equipment is used in the condition where it is contained in a covering case for the purposes of protection from an external force and improvement in external appearance. Such a covering case in related art should be formed with a hole for exposing the connector of the portable terminal equipment, so as to allow the electrical connection between the portable terminal equipment and the cradle equipment through the respective connectors. To the contrary, in the example shown in FIGS. 12A to 12C, such a hole need not be formed in a covering case for the portable terminal equipment 120 because the portable terminal equipment 120 and the cradle equipment 220 are connected by radio through the devices 100 and 200 containing the antenna elements rather than the electrical connection through the connectors.

However, there is a possibility of misalignment between the device 100 and the device 200 due to the thickness of the covering case in the condition where the portable terminal equipment 120 covered with the covering case is mounted in the cradle equipment 220, causing a large degradation in communication sensitivity.

Figure 13A:
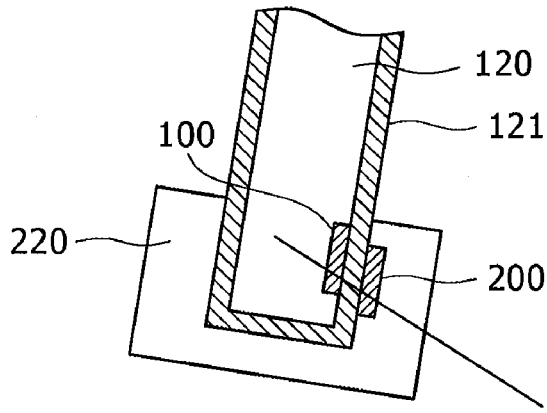
FIG. 13A is a view similar to FIG. 12B, showing a modification such that the portable terminal equipment is enclosed by a covering case.

More specifically, as shown in FIG. 13A, the device 100 built in the portable terminal equipment 120 may not be aligned to the device 200 built in the cradle equipment 220 because of the thickness of a case 121 covering the portable terminal equipment 120.

Figure 13B:
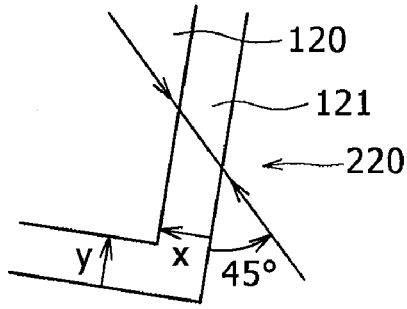
FIG. 13B is a schematic enlarged view of a main part in FIG. 13A.

FIG. 13B shows a modification wherein the antenna elements embedded in the devices 100 and 200 are inclined according to the thickness of the case 121.

FIG. 13B is a schematic sectional view in the condition where the mounted position of the portable terminal equipment 120 in the cradle equipment 220 has been changed because of the thickness of the case 121. More specifically, the displacement in the direction of the Y axis shown in FIG. 13B corresponds to the displacement of the bottom surface of the portable terminal equipment 120 from the bottom surface of the recess of the cradle equipment 220 due to the thickness of the case 121, and the displacement in the direction of the X axis shown in FIG. 13B corresponds to the displacement of the back surface of the portable terminal equipment 120 from the side surface of the recess of the cradle equipment 220 due to the thickness of the case 121.

Figure 13C:
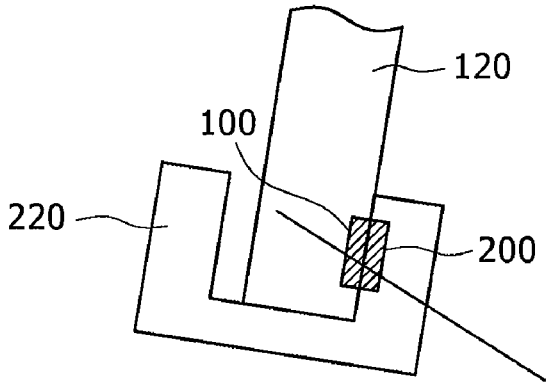
FIG. 13C is a view similar to FIG. 13A, showing a modification such that the covering case is not used.

If the thickness of the case 121 is uniform, the displacement in the direction of the X axis is equal to the displacement in the direction of the Y axis in FIG. 13B. Accordingly, by 45° inclining the antenna elements embedded in the device 100 in the downward direction, i.e., the direction opposite to the direction of the Y axis with respect to the direction perpendicular to the YZ plane and by 45° inclining the antenna elements embedded in the device 200 in the upward direction, i.e., the direction of the Y axis with respect to the direction perpendicular to the YZ plane, the polarization planes of the antenna elements in the device 100 can be opposed to the polarization planes of the corresponding antenna elements in the device 200. FIG. 13C shows a condition where the case 121 is not used and the antenna elements are inclined as mentioned above. Also in this case, the polarization planes of the antenna elements in the device 100 can be opposed to the polarization planes of the antenna elements in the device 200. Thus, the portable terminal equipment 120 and the cradle equipment 220 can be used without incurring a large change in communication sensitivity according to the presence or absence of the case 121.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A radio communication system for performing radio communication between a first antenna and a second antenna, comprising said first antenna including a plurality of antenna elements configured to form polarization planes orthogonal to each other in three-axial directions;

said second antenna including a plurality of antenna elements configured to form polarization planes orthogonal to each other in three-axial directions;

said first antenna and said second antenna are arranged so that said polarization planes formed by said antenna elements of said first antenna are respectively opposed to said polarization planes formed by said antenna elements of said second antenna; and the communication between said first antenna and said second antenna is performed by using three independent polarized waves.

2. The radio communication system according to claim 1, wherein at least one of said first antenna and said second antenna is provided with correcting means for correcting the interference between said polarized waves.

3. A communication method for a radio communication system for performing radio communication between a first antenna and a second antenna each having a plurality of antenna elements configured to form polarization planes orthogonal to each other in three-axial directions, comprising the steps of:

arranging said first antenna and said second antenna so that said polarization planes formed by said antenna elements of said first antenna are respectively opposed to said polarization planes formed by said antenna elements of said second antenna; and performing the communication between said first antenna and said second antenna by using three independent polarized waves.

* * * * *